US005366234A

United States Patent [19]

Rohrmoser

[11] Patent Number: 5,366,234

[45] Date of Patent: Nov. 22, 1994

[54] SKI WITH A PROFILED TOP

[75] Inventor: Alois Rohrmoser, Wagrain, Austria

[73] Assignee: Atomic Skifabrik Alois Rohrmoser, Wagrain, Austria

[21] Appl. No.: 215,407

[22] Filed: Mar. 14, 1994

Related U.S. Application Data

[63] Continuation of Ser. No. 101,678, Aug. 2, 1993, abandoned, which is a continuation of Ser. No. 762,555, Sep. 18, 1991, abandoned.

[30] Foreign Application Priority Data

Sep. 27, 1990 [AU] Australia ..... A 1962/90

[51] Int. Cl.[5] ..... A63C 5/14

[52] U.S. Cl. ..... 280/610; 280/607; 280/609

[58] Field of Search ..... 280/602, 607, 609, 610

[56] References Cited

U.S. PATENT DOCUMENTS

| | | | |
|---|---|---|---|
| 2,526,137 | 10/1950 | Hunt | 280/610 |
| 2,971,207 | 2/1961 | Eicholtz | 280/610 X |
| 2,995,379 | 8/1961 | Head | 280/610 |
| 4,671,529 | 6/1987 | LeGrand et al. | 280/610 |
| 4,679,813 | 7/1987 | Girard . | |
| 4,681,725 | 7/1987 | Maruyama | 280/610 X |
| 4,697,820 | 10/1987 | Hayashi et al. | 280/602 X |
| 5,035,442 | 7/1991 | Arnsteiner | 280/602 |
| 5,238,260 | 8/1993 | Scherubl | 280/610 |

FOREIGN PATENT DOCUMENTS

| | | | |
|---|---|---|---|
| 347831 | 1/1979 | Austria . | |
| 378327 | 7/1985 | Austria . | |
| 380172 | 4/1986 | Austria . | |
| 380792 | 7/1986 | Austria . | |
| 386126 | 7/1988 | Austria . | |
| 992010 | 5/1947 | France . | |
| 1350389 | 12/1963 | France . | |
| 2540391 | 4/1984 | France . | |
| 631073 | 6/1936 | Germany . | |
| 1094644 | 10/1952 | Germany . | |
| 3800127 | 8/1988 | Germany . | |
| 3803483 | 9/1988 | Germany . | |
| 3933717 | 4/1990 | Germany . | |
| 3937617 | 7/1990 | Germany . | |
| 107469 | 5/1943 | Sweden | 280/610 |
| 91/09653 | 7/1991 | WIPO . | |

*Primary Examiner*—Brian L. Johnson
*Attorney, Agent, or Firm*—Collard & Roe

[57] ABSTRACT

A ski with a profiled top with a core located between a top strap, a bottom strap and a pair of side faces. An intermediate ply is located over the top strap and underneath a top running surface ply. The intermediate ply or the core, or both, has a varying shape over the length of the ski. The intermediate ply additionally includes a damping element formed therein.

4 Claims, 5 Drawing Sheets

SKI WITH A PROFILED TOP

This is a continuation of my copending U.S. patent application Ser. No. 08/101,678, filed Aug. 2, 1993, now abandoned, which in turn is a continuation of U.S. patent application Ser. No. 07/762,555, filed Sep. 18, 1991, now abandoned.

BACKGROUND OF THE INVENTION

1. Field of the Invention

The present invention relates to a ski with a core located between a top strap and a bottom strap. An intermediate ply is located over the top strap. Either the core or the intermediate ply, or both, vary in thickness or width, or both, over the length of the ski, resulting in a profiled top. A reinforcement or damping element or both can be formed from the intermediate ply.

2. The Prior Art

A ski is disclosed in Austrian Patent AT-PS 380,172, which describes a plastic foamed core in between a top strap and a bottom strap forming sheet-like components. The top strap is profiled by supporting the top strap in a mold and by injecting the plastic foam under pressure into the core part. This process requires a very large number of complicated molding dies, as a different mold is required for each different ski length.

In another known ski, pursuant to German Patent DE-OS 39 37 617, a strip-shaped plastic band is laid into a U-shaped plastic profile which is connected to the core. With this structure, however, longitudinally extending cracks may form along the top into which snow and ice can penetrate.

Another ski is disclosed in U.S Pat. No. 4,679,813, which describes the use of a torsion rod. This rod is attached to the top surface of the ski, in order to resist twisting. However, the top surface of the ski is disrupted by the torsion rod, and spots form in which snow and ice can become lodged. This rod may also undesirably stiffen the ski under certain conditions.

Yet another known ski disclosed in the inventor's Austrian Patent AT-PS 347 831 has a top strap and a bottom strap, arranged around a core. The core varies in thickness over its length. The core includes at least one intermediate strap, extending from the tip of the ski to approximately the end of the ski. This intermediate layer varies in distance from the top strap, while maintaining a constant distance from the bottom strap. This makes it possible to vary the thickness of the ski over its entire length. The ski can thus correspondingly counteract the different stresses and levels of bending momentum which occur. Additionally, this provides sufficient pretension against bending of the ski in the direction of the running surface.

Another ski disclosed in Austrian Patent AT-PS 386,126 describes a ski structured as a sandwich element which is formed with a core and a top and bottom strap. Between the binding region and the two ends of the ski, roof-shaped raised projections are arranged over the surface of the ski, with additional core components placed therein. These roof-shaped projections, however, only affect the aesthetics of the ski. The configuration of the core material, and the different lengths of the skis, result in unpredictable properties of the ski.

SUMMARY OF THE INVENTION

It is therefore an object of the present invention to produce a ski of the type mentioned above which provides uniform distribution of the stresses placed upon the ski.

It is a further object of the invention to provide a structure where the dynamic deformation characteristics can be easily adapted to various requirements.

It is still a further object of the invention to provide a ski which can be produced using the greatest possible number of identical parts.

These and other related objects are accomplished according to the present invention by providing a ski with a core located between a top strap and a bottom strap which may be formed of multiple plies. An additional intermediate ply is located over the top strap. Either the core or the intermediate ply, or both, varies in thickness or width, or both, over the length of the ski. A reinforcement or damping element, or both, can be formed from the intermediate ply.

Because of the varying height of the ski, both in the longitudinal direction and the perpendicular direction, the tension-resistant characteristics of the ski can be adapted to the stress on the ski beginning at the inner side edge. The tension-resistant characteristics serve to prevent deformation of the ski which occurs in its cross-sectional region. This ensures quiet guiding of the ski when going around curves at high speeds, and avoids the risk of cutting, where the outside edge of the ski is subject to overly great bearing stress. Furthermore, by means of an appropriate selection of material for the intermediate layer and by arranging the plies of the intermediate layer as a function of the ski length, the stress resistance, flexibility and damping properties can be improved. In addition, the greatest possible uniform distribution of the loads over the entire running surface is achieved. This serves to additionally improve the gliding properties of the ski according to the invention.

An alternate embodiment includes the intermediate ply formed as one of the plies of the top strap. The top strap can thus serve as a structural element of the ski and can be prefabricated in a parallel production process, before it is combined with the other components, namely, the core, bottom strap and side faces. In this way, it is also possible to produce an interchangeable top strap which can connect with any desired core system. A surprising advantage is achieved in that great flexibility can be introduced in the production of the skis.

The width of the intermediate ply can deviate from the ski width and can be formed narrower than the width of the entire ski. In such a case, a top surface ply located above the intermediate ply may extend down on either side of the intermediate ply.

Alternatively, a top strap ply below the intermediate ply may extend upward on either side of the intermediate ply. The intermediate ply can thus be protected against ambient conditions, especially against moisture absorption, by these adjacent covering plies. This broadens the spectrum of materials which can be used for the intermediate ply.

An alternate embodiment of the ski can be formed by joining, such as by gluing the plies of the top strap and the core together. Conventional production processes and equipment can be used to manufacture skis with an intermediate ply with only slight modifications. This makes it possible to produce the skis in a cost-effective manner.

The top surface ply can be made of thermoplastic material with the intermediate ply being made from a different material, especially material with greater strength.

In a further embodiment the intermediate ply can also be formed of different layers of material, each with different mechanical and vibration characteristics. Because of the different combinations of materials, precise adjustment of the properties of each ski can be achieved. Therefore, it is also possible to achieve specific properties, such as torsion and bending strength, vibration damping behavior, etc., when using a standard core structure, both for downhill skiing and for trail skiing.

The intermediate plies can be arranged to form steps both in the longitudinal direction of the ski and perpendicular thereto. The configuration of the top strap of the ski can be adjusted in accordance with the desired stress distribution. Instead of just the intermediate plies, the top strap, or both, can be formed as steps.

The bending of the ski can be adapted to an ideal bending line, with which the least disruption of travel characteristics occurs. In the area of the binding, the top strap is flat, which makes it possible to attach the binding without additional connection means.

In the area just in front and in back of the binding, the ski surface can be raised above the flat portion to form a ridge. The ridge can reduce hazards such as those caused by projecting binding parts, which are particularly dangerous while riding a ski lift.

In a further embodiment, the intermediate ply can also serve as a vibration damping component. The top strap or the intermediate ply, or both, can be molded into depressions formed in the core, either in certain areas or over the entire length of the ski. This can positively influence the strength of the ski.

In an alternate embodiment, the intermediate ply can also be constructed as a sandwich component in which the carrier or a damping element, or both, form plies within the sandwich component. With a sandwich construction of the intermediate ply, additional elements to influence the mechanical and/or vibration characteristics of the core layer can be integrated into this ply. These can be formed together in the production of the top strap. In this way, additional manufacturing steps are eliminated.

A further advantageous embodiment is achieved by providing an additional intermediate ply between the bottom strap and the core. This provides a symmetrical tension progression and therefore a greater lifetime of the bearing elements of the ski body.

In addition, the intermediate ply can be structured concave perpendicular to the longitudinal axis of the ski. This effectively prevents snow and ice from accumulating.

The additional intermediate ply can be formed by multiple plies. This allows automated feed and charging of the production systems with components which form the intermediate plies.

The intermediate plies and additional intermediate plies can be arranged exactly, with mirror-image symmetry, with respect to horizontal or vertical, or both, planes.

The intermediate plies or additional intermediate plies, or both, can also be arranged non-symmetrically with reference to a vertical plane of symmetry. The higher stress which particularly occurs on the inside edge of a ski can be accounted for, resulting in better tracking around curves.

BRIEF DESCRIPTION OF THE DRAWINGS

Other objects and features of the present invention will become apparent from the following detailed description considered in connection with the accompanying drawings which discloses several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
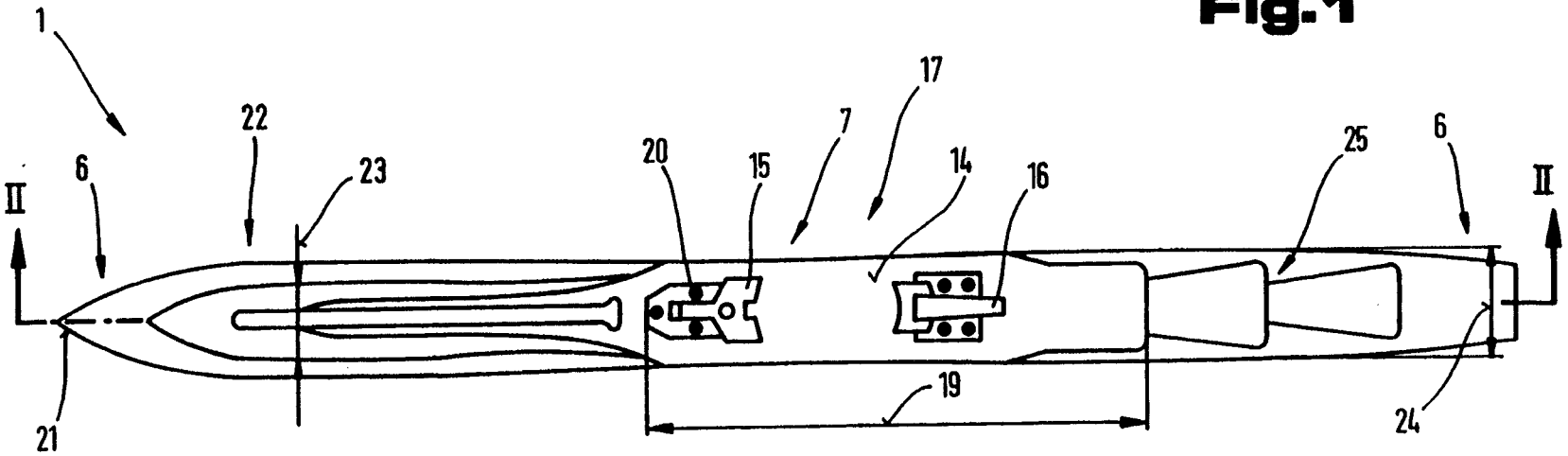
FIG. 1 is a plan view of a ski with a profiled top according to the invention.
Figure 2:
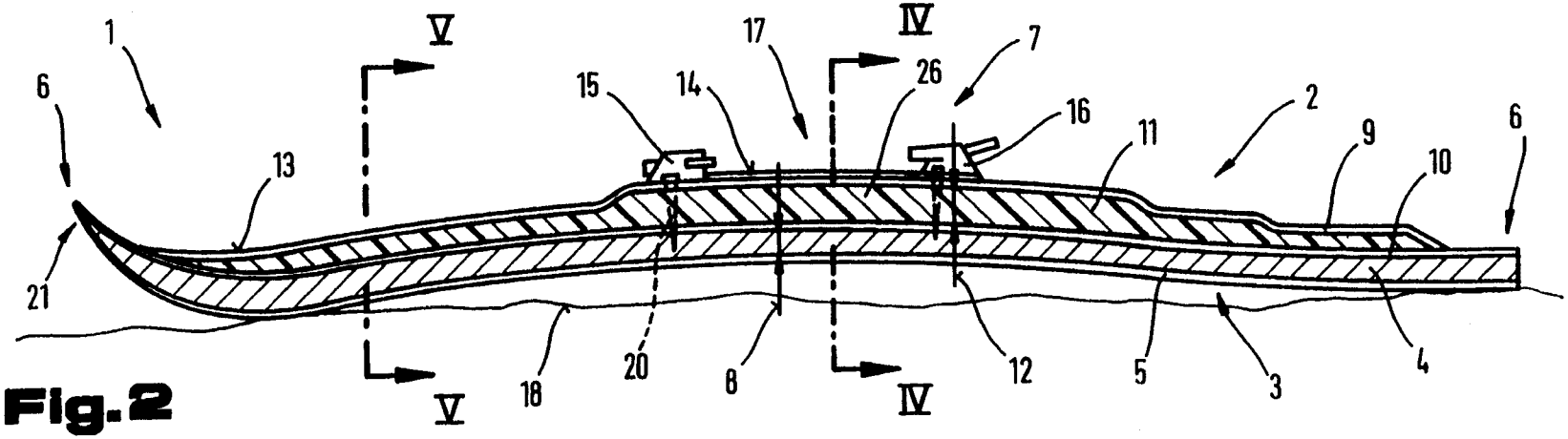
FIG. 2 is a cross-sectional view taken along line II—II from FIG. 1.

Turning now in detail to the drawings, and in particular, FIGS. 1 and 2, there is shown a ski 1 with a top strap 2, a bottom strap 3 and a core 4 arranged between them. One ply of bottom strap 3 forms a running surface coating 5. Core 4 has an increasing thickness 8 from ski ends 6, to a binding region 7 located generally in the central part of ski 1. Top strap 2, which is connected to core 4, e.g., glued to it, has several plies including a top surface ply 9, a cover ply 10 and an intermediate ply 11 located between plies 9 and 10. Intermediate ply 11 has a varying thickness 12 in the longitudinal direction of ski 1 and in a direction of ski 1 perpendicular thereto. Top surface ply 9 is adapted to the relief-like contours of intermediate ply 11 formed by thickness 12 of intermediate ply 11, which causes a top 13 of ski 1 to be structured as steps. In binding region 7, top 13 demonstrates an approximately level binding contact surface 14 to hold a ski binding 17 including a toe clamp 15 and a heel clamp 16. To achieve an approximately level binding contact surface 14, which runs approximately parallel to a ground contact surface 18 of ski 1, thickness 12 of intermediate ply 11 is adapted to the varying thickness 8 of core 4. The combined thickness of thickness 8 and thickness 12 over a length 19 approximately the same, and is greater than the thickness of the regions adjacent surface 14 in the longitudinal ski direction.

Ski binding 17 is fastened to ski 1 via fastening means 20, e.g., screws, for example, via intermediate layer 11, or core 4. Top strap 2 with profiled top 13 forms a ridge 22 in the region approximately between a ski tip 21 and the toe clamp 15, where an average width 23 is less than an average ski width 24. In the region between the heel clamp 16 and rear ski end 6, profiled top 13 forms a set of, e.g., scale-like steps 25. For example, scale-like steps 25 are wing-shaped and become narrower as they meet the next higher step. With the spatial sizing of intermediate ply 11, in connection with a material 26 with varying strength or vibration characteristics, for example, specific properties for various areas of use of ski 1 can be achieved. In particular, a layer of material which holds up well under thermal stress, made of plastic, foamable glass or carbon laminates, etc., can be used as material 26 for intermediate ply 11.

Figure 3:
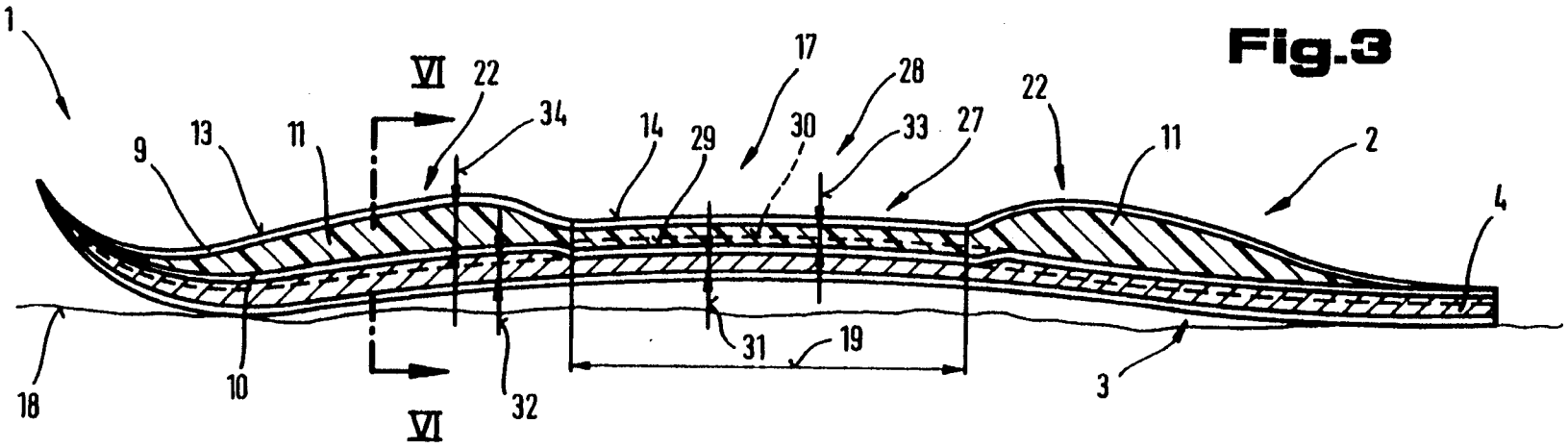
FIG. 3 is a cross-sectional side view of a further embodiment of the invention.

In FIG. 3, ski 1 is shown with a top strap 2 molded into a recess 27 of core 4. Core 4 has a depression 29 relative to a profile line 30, drawn as a broken line, in an assembly region 28 for ski binding 17. With depression 29, an approximately parallel thickness 31 of core 4 over length 19 of assembly region 28 is achieved, which is less than a greatest thickness 32 of regions adjacent to the assembly region. Bottom strap 3 is arranged on core 4 in the direction of ground contact surface 18. Top strap 2 is formed of several plies, including top surface ply 9, intermediate ply 11 and cover ply 10, all connected with core 4. Intermediate ply 11 is deformed between top surface ply 9 and cover ply 10, especially thermally deformed, and demonstrates a uniform thickness 33 over length 19, for example, in assembly region 28, which is less than a maximum thickness 34 of intermediate ply 11 in the regions adjacent to assembly region 28.

With this structure, profiled top 13 of top surface ply 9 is connected with intermediate ply 11 to form ridge 22. Because of uniform thickness 31 over length 19, level assembly region 28 for ski binding 17, running approximately parallel to bottom strap 3, is achieved, which is arranged recessed relative to the adjacent regions of top 13. Depression 29 provided for the purpose of placing the ski binding lower, and the weakening of core 4 resulting from this, can be avoided with the arrangement of multi-ply top strap 2 with intermediate layer 11 demonstrating a greater strength as compared with core 4. As shown in broken lines in FIG. 3, intermediate ply 11 can also be arranged in depression 29 over almost the entire ski length.

Figure 5:
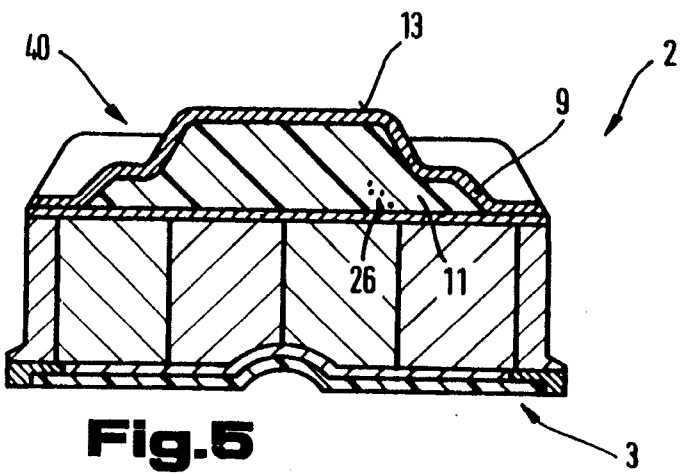
FIG. 5 is a frontal cross-sectional view taken along line V—V in FIG. 2.
Figure 4:
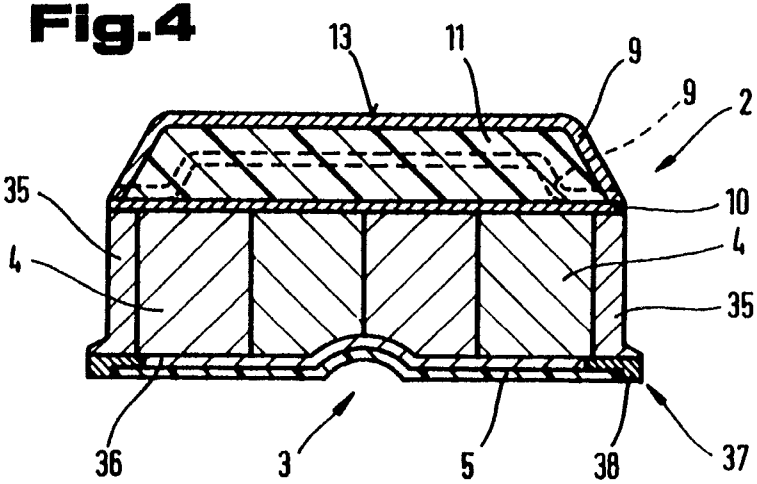
FIG. 4 is a frontal cross-sectional view taken along line IV—IV in FIG. 2.

Furthermore, cross-sections of ski 1 with multi-ply top strap 2 are shown in FIGS. 4 and 5. Core 4 is surrounded by top strap 2, bottom strap 3, and a pair of side faces 35 arranged on either side of core 4. Bottom strap 3 is formed in several plies, by running surface coating 5 and at least one tension strap 36 connected with core 4, with a pair of steel edges 38 arranged in the region of a pair of longitudinal side edges 37. Multi-ply top strap 2 is formed by top surface ply 9, cover ply 10 connected to move with core 4, especially glued to it, and intermediate ply 11 arranged between these and connected with them, especially glued to them. Top surface ply 9 is deformed at longitudinal side edges 37, in the direction of cover ply 10, and is glued, bonded, etc. to the latter.

As is evident in FIGS. 4 and 5, profiled top 13 of top strap 2 can be configured to the various requirements in the longitudinal direction of ski 1, e.g., by thermal deformation of top surface ply 9 and intermediate ply 11, where the thermal deformation allows pressing to a smaller cross-section, while partial foaming to produce a greater cross-section than the original one can also take place. As shown in broken lines in FIG. 5A, intermediate ply 11 can also be formed of several plies.

Figure 5A:
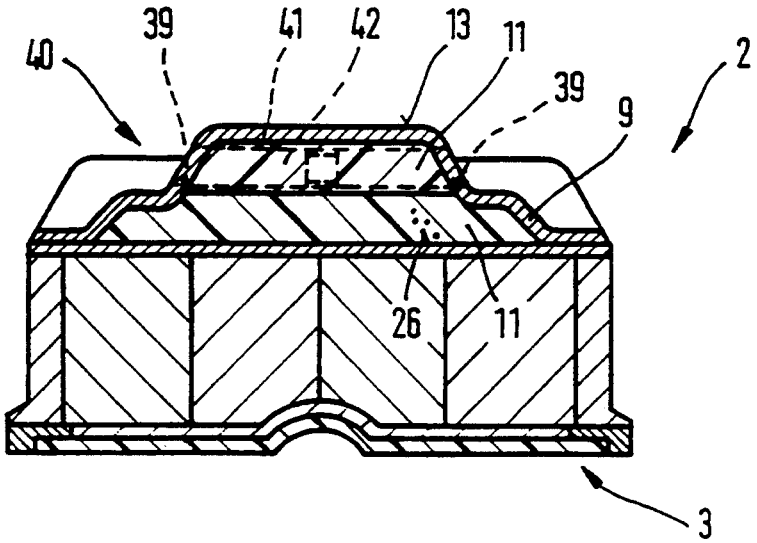
FIG. 5A is a frontal cross-sectional view similar to FIG. 5 of an alternate embodiment of the ski.

FIG. 5A shows a pair of openings 39 of side faces 40 of top strap 2, structured in steps in a region of ski 1, for example, an interchangeable insertion element 42 with strength and/or vibration characteristics different from material 26 of intermediate ply 11 can be arranged in a clearance 41 of intermediate ply 11. Insertion elements 42 can also demonstrate a significantly greater density as compared with material 26, for example. With the arrangement of clearances 41 with insertion elements 42, it is possible to adapt the travel behavior of ski 1 to changing conditions of use.

Figure 6:
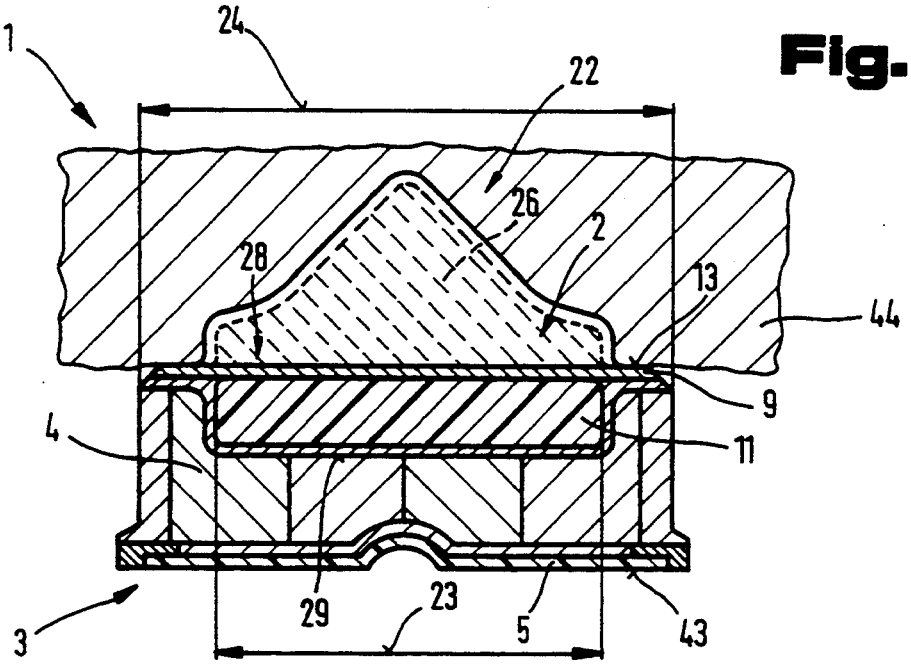
FIG. 6 is a front cross-sectional view along line VI—VI of FIG. 3 of a further embodiment of a ski according to the invention.

FIG. 6 shows another structure of multi-ply top strap 2 with intermediate ply 11. In a partial region of ski 1, especially in assembly region 28, top 13 of top surface ply 9 is structured with a level surface and parallel to a running surface 43 formed by running surface coating 5 of bottom strap 3. In this region, intermediate ply 11 is arranged in depression 29 of core 4, for which purpose width 23 of intermediate ply 11 is less than ski width 24. In the adjacent regions in the longitudinal ski direction, top 13 of top surface ply 9 is spatially deformed to yield the ridge 22, for example. In these regions, intermediate ply 11, for example, demonstrates a greater volume, which can be achieved, for example, by foaming the material 26 of intermediate ply 11 in a heated mold 44.

Figure 7:
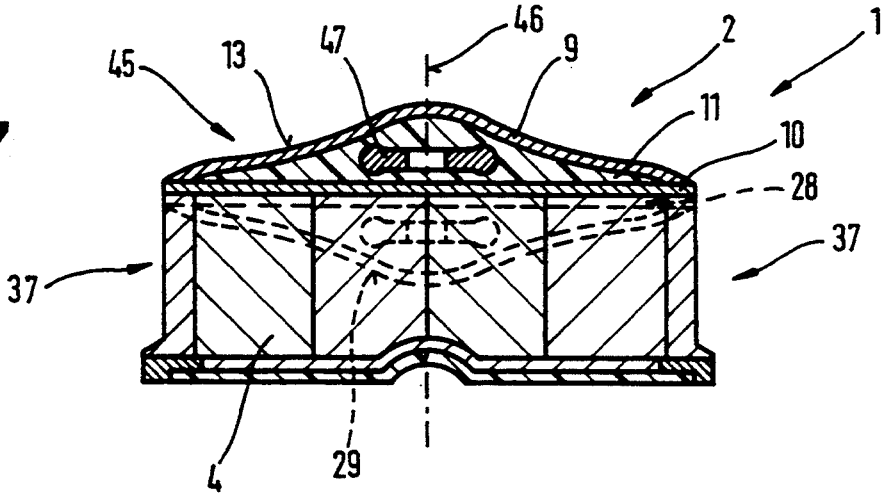
FIG. 7 is a front cross-sectional view of another embodiment of a ski according to the invention with an intermediate ply as a sandwich component.

FIG. 7 shows a cross-sectional region of ski 1 with a multi-ply sandwich component 45 as top strap 2. The sandwich component 45 is formed by top surface ply 9, cover ply 10 and intermediate ply 11 arranged between them. A reinforcement and/or damping element 47 is integrated and arranged within the intermediate ply in the longitudinal ski direction and is approximately symmetrical to a center ski axis 46. Here, top 13 of top strap 2 has a convex outer surface dropping in the direction of the longitudinal side edges 37. Reinforcement and/or damping element 47 can optionally be formed of different material to achieve desired gliding properties. For example, it is also possible to arrange the reinforcement and/or damping element 47 in the form of a spacial lattice reinforcement, integrated into intermediate ply 11, which achieves great strength values or resistance values with a lower component weight. To achieve a flat, level assembly region 28, sandwich component 45 can be arranged in depression 29 of core 4 in assembly region 28, as shown as a broken line.

Figure 8:
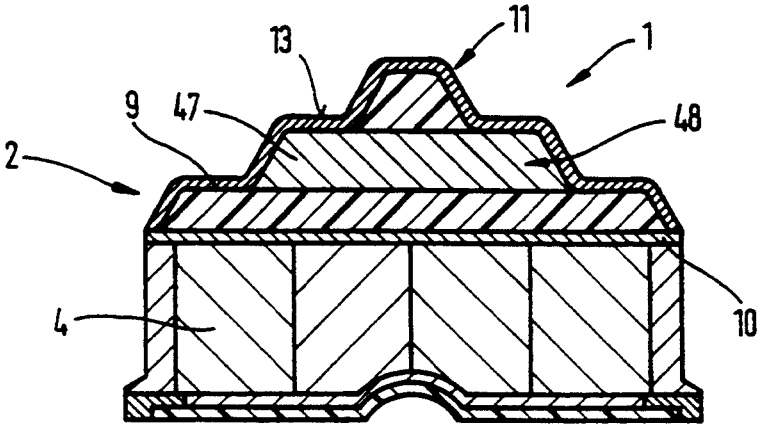
FIG. 8 is a front cross-sectional view of yet another embodiment of a ski according to the invention with a carrier and/or damping element as an intermediate ply.

FIG. 8 shows ski 1 with a stepped top strap 2. On core 4, and connected with it, intermediate ply 11 is structured with several plies between cover ply 10 and top surface ply 9, where a center ply 48, for example, is formed from a reinforcement and/or damping element 47. Depending on the requirements concerning properties of ski 1, reinforcement and/or damping element 47 can be formed of different materials, such as aluminum, fiber-reinforced plastics, carbon mats, etc., for example. The additional plies of intermediate ply 11 can be thermoplastics, rubber, elastomers, etc., for example. Of course, the materials of intermediate ply 11 can also be arranged in different sequence, in order to achieve special properties, just as they can also be used in different combinations. The steps resulting from the varying thicknesses of the individual plies of intermediate ply 11, to achieve profiled top 13, is only shown as an example in this structure.

Figure 9:
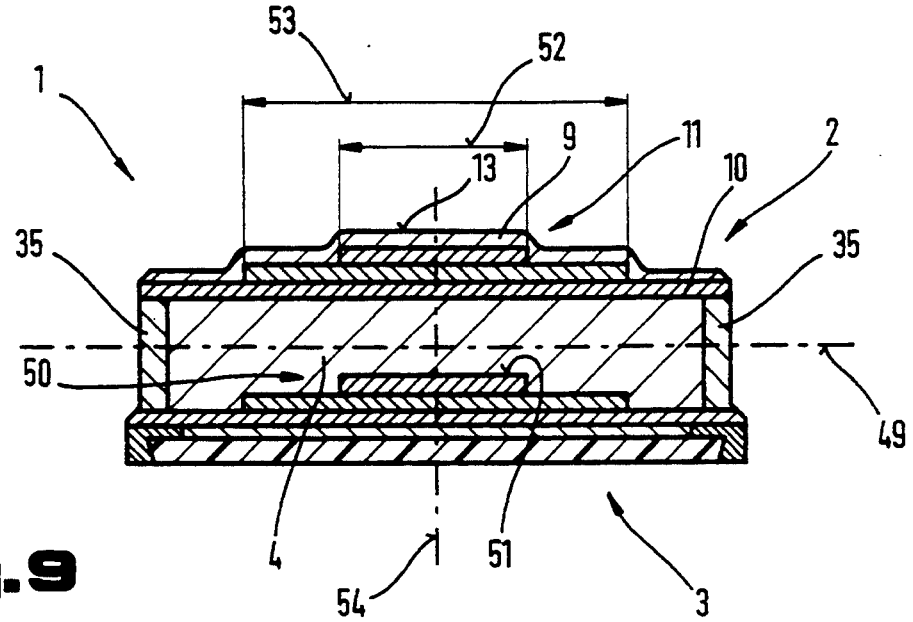
FIG. 9 is a front cross-sectional view of an alternate embodiment of a ski according to the invention with an intermediate ply arranged symmetrically to a horizontal plane.

FIG. 9 shows ski 1 with top strap 2, bottom strap 3, and side faces 35 which surround core 4. Between cover ply 10 and top surface ply 9 forming top 13, multi-ply intermediate ply 11 is arranged. With reference to a plane 49 running horizontally through ski 1, a multi-ply intermediate ply 50 is arranged between bottom strap 3 and core 4, with layers the same as intermediate ply 11. This is molded into a recess 51 of core 4 adapted to the contours. Intermediate ply 11, cover ply 10, and intermediate ply 50 are connected together and to core 4, e.g., glued. To achieve specific mechanical properties, the individual plies of intermediate plies 11, 50 can demonstrate different widths 52, 53, which results in stepping of top 13 and recess 51, for example. With reference to a vertical plane 54 running through the ski, intermediate plies 11, 50 are preferably arranged symmetrically.

Figure 10:
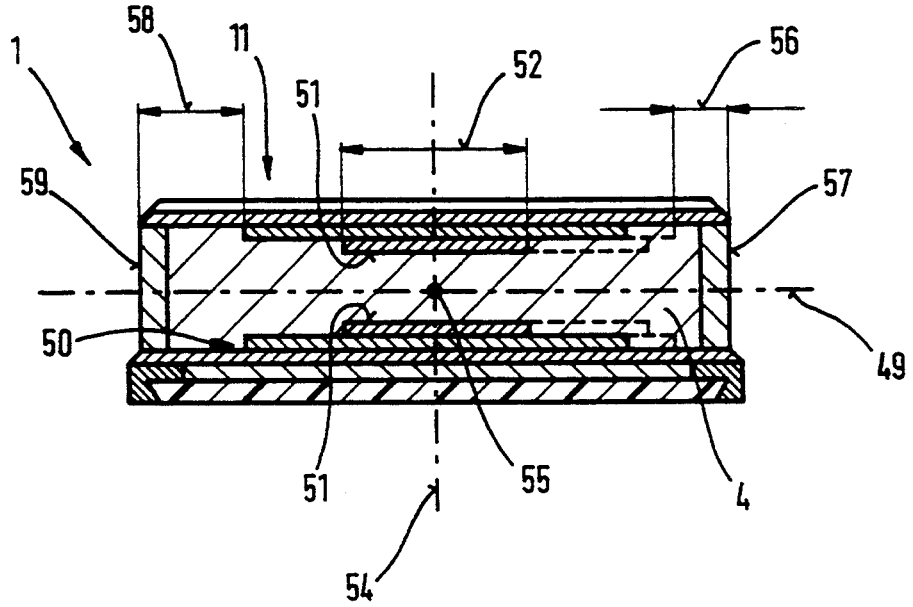
FIG. 10 is a front cross-sectional view of a further embodiment of a ski according to the invention, with an intermediate ply arranged relative to a horizontal and/or vertical plane of symmetry.

FIG. 10 shows multi-ply intermediate plies 11, 50 arranged in mirror-image form in depressions 51 of core 4 with reference to horizontal plane 49. The narrower intermediate plies 11, 50, having a small width 52, are arranged closer to a longitudinal center axis 55 of ski 1. With reference to vertical plane 54 arranged to run through longitudinal center axis 55, intermediate plies 11, 50 are arranged symmetrically. As is further shown with broken lines, it is also possible, however, to structure intermediate plies 11, 50 non-symmetrical with reference to vertical plane 54, in order to achieve specific mechanical properties, especially to form a distance 56 to an inside edge 57 to be smaller than a distance 58 to a side edge 59. This arrangement particularly improves the stress resistance of ski 1 with the corresponding material for the individual plies of intermediate plies 11, 50 along its inside edge 57, which has a particularly advantageous effect when going through curves.

While only several embodiments of the present invention have been shown and described, it is to be understood that many changes and modifications may be made thereunto without departing from the spirit and scope of the invention as defined in the appended claims.

What is claimed is:

1. A longitudinally extending ski with a profiled top surface and a level binding contact surface, comprising:

(a) a top strap including (i) a top surface ply;

(ii) an intermediate ply located below and connected to said top surface ply, said intermediate ply has an intermediate ply thickness; and (iii) a covering layer located below said intermediate ply;

(b) said top strap is arranged as at least one step having surfaces which are generally parallel to each other;

(c) a bottom strap;

(d) a pair of side faces;

(e) a core disposed between and bonded to said covering layer, said bottom strap and said side faces, said core has a core thickness, wherein said intermediate ply thickness and said core thickness vary in the region of the level binding contact surface, the combined thickness of said intermediate ply and said core is approximately the same across the level binding contact surface; and (f) said top surface ply is deformed in a direction toward said covering layer at least along the length of the level binding contact surface and above said core and said side faces, wherein said top surface ply extends down around either side of said intermediate ply and is bonded to said covering layer of said top strap above said side faces to enclose said intermediate ply.

2. A longitudinally extending ski with a ski tip, a ski end and a profiled top surface, comprising:

(a) a bottom strap;

(b) a core bonded onto said bottom strap;

(c) a top strap including:

(i) a covering layer bonded to said core; said bottom strap, said core and said covering layer extending from the ski end to adjacent the ski tip;

(ii) an intermediate ply bonded onto said covering layer;

(iii) a thermoplastic top surface ply bonded onto said intermediate ply;

(d) a pair of side faces extending longitudinally along and bonded to either side of said core;

(e) said intermediate ply and said thermoplastic top surface ply having a varying shape and thickness over the length and width of the ski; and (f) said top surface ply is deformed in an area above said core and said side faces in a direction toward said covering layer, wherein said top surface ply extends down around either side of said intermediate ply and is bonded to said covering layer of said top strap above said side faces to enclose said intermediate ply.

3. The longitudinally extending ski according to claim 2, wherein said bottom strap, said core, said covering layer, said intermediate ply and said thermoplastic top surface ply are bonded together by gluing.

4. The ski according to claim 2, wherein said intermediate ply is narrower in width than the ski.

* * * * *